US012435292B2

(12) United States Patent
Liu et al.

(10) Patent No.: US 12,435,292 B2
(45) Date of Patent: Oct. 7, 2025

(54) ANTI-CORROSIVE LUBRICANT COMPOSITION FOR ELECTRICAL APPARATUS

(71) Applicants: Henkel AG & Co. KGaA, Duesseldorf (DE); Guangdong Yingde Dosoon Fine Chemical Industry Co., Ltd., Yingde (CN)

(72) Inventors: GuoGuang Liu, Shanghai (CN); Xiaohui Pan, Yingde (CN); Zengfan Liu, Yingde (CN)

(73) Assignees: Henkel AG & Co. KGaA, Duesseldorf (DE); Guangdong Yingde Dosoon Fine Chemical Industry Co., Ltd., Guangdong (CN)

( * ) Notice: Subject to any disclaimer, the term of this patent is extended or adjusted under 35 U.S.C. 154(b) by 0 days.

(21) Appl. No.: 18/795,790

(22) Filed: Aug. 6, 2024

(65) Prior Publication Data

US 2024/0392205 A1 Nov. 28, 2024

Related U.S. Application Data

(63) Continuation of application No. PCT/CN2022/076816, filed on Feb. 18, 2022.

(51) Int. Cl.

| | |
|---|---|
| ***C10M 133/16*** | (2006.01) |
| ***C10M 125/02*** | (2006.01) |
| ***C10M 135/10*** | (2006.01) |
| ***C10M 163/00*** | (2006.01) |
| *C10M 125/20* | (2006.01) |
| *C10M 159/06* | (2006.01) |
| *C10N 30/04* | (2006.01) |
| *C10N 30/12* | (2006.01) |

(52) U.S. Cl.

CPC ..... *C10M 133/16* (2013.01); *C10M 125/02* (2013.01); *C10M 135/10* (2013.01); *C10M 163/00* (2013.01); *C10M 125/20* (2013.01); *C10M 159/06* (2013.01); *C10M 2201/041* (2013.01); *C10M 2201/16* (2013.01); *C10M 2215/082* (2013.01); *C10M 2219/044* (2013.01); *C10N 2030/04* (2013.01); *C10N 2030/12* (2013.01)

(58) Field of Classification Search

CPC ..... C10M 133/16; C10M 125/02; C10M 135/10; C10M 163/00; C10M 125/20; C10M 159/06; C10M 2201/041; C10M 2201/16; C10M 2215/082; C10M 2219/044; C10N 2030/04; C10N 2030/12

See application file for complete search history.

(56) References Cited

U.S. PATENT DOCUMENTS

| | | | | |
|---|---|---|---|---|
| 2,841,555 | A * | 7/1958 | Thomas | C10M 5/00 508/514 |
| 4,313,837 | A * | 2/1982 | Vukasovich | C23F 11/142 252/387 |
| 4,366,076 | A * | 12/1982 | Clark | C10M 129/38 508/516 |
| 4,787,995 | A * | 11/1988 | Nichols | C10M 129/56 508/451 |
| 5,104,558 | A * | 4/1992 | Matsuzaki | C10M 159/24 508/330 |
| 2010/0279904 | A1 | 11/2010 | Deskin et al. | |
| 2015/0228373 | A1 | 8/2015 | Martin et al. | |
| 2016/0137948 | A1* | 5/2016 | Yoshii | C10M 129/70 508/308 |
| 2019/0277339 | A1 | 9/2019 | Jaiswal et al. | |

FOREIGN PATENT DOCUMENTS

| | | | |
|---|---|---|---|
| CN | 101724496 | A | 6/2010 |
| CN | 107573986 | A | 1/2018 |
| CN | 108517246 | A | 9/2018 |
| CN | 109294707 | A | 2/2019 |
| CN | 109777556 | A | 5/2019 |
| CN | 109897718 | A | 6/2019 |
| CN | 113862066 | A | 12/2021 |

OTHER PUBLICATIONS

International Search Report for PCT/CN2022/076816 mailed Oct. 9, 2022.

* cited by examiner

*Primary Examiner* — Ellen M McAvoy

(74) *Attorney, Agent, or Firm* — Mary K. Cameron

(57) ABSTRACT

The present invention relates to lubricant composition comprising:

a corrosion inhibitor comprising A1 and A2:

A1: 0.3-3 wt. % of one or more octadecylamine N—$C_{10-20}$ alkanoyl sarcosinates, A2: 1-5 wt. % of one or more substances selected from lanolin magnesium soap, lanolin calcium soap, lanolin barium soap, lanolin lithium soap, barium petroleum sulfonate and sodium petroleum sulfonate, 0.2-2 wt. % of one or more surfactants selected from Span-80, AEO-9 and TX-4;

10-40 wt. % of a lubricant base, 0.2-2 wt. % of fullerene C60, 50-80 wt. % of a solvent selected from D80, D100 and D110, and optionally, a propellant gas;

all wt. % percentages are based on the total weight of the lubricant composition.

12 Claims, No Drawings

ANTI-CORROSIVE LUBRICANT COMPOSITION FOR ELECTRICAL APPARATUS

TECHNICAL FIELD

The present invention relates to an anti-corrosive lubricant composition for electrical apparatus, especially to an environmental-friendly anti-corrosive lubricant composition with excellent anti-corrosion property, excellent electrical insulating property and excellent lubricating property.

BACKGROUND OF THE INVENTION

Precise instruments and industrial devices oftentimes suffer from corrosion, rusting and abrasive wear due to contaminants (such as dusts, greasy dirt, water scale, rusts and the like) coming from environment and operation, leading to reduction of working life and working performance, or even leading to broken of instruments and devices. Therefore, regular maintenance is required.

Instruments and devices are assembled often with metallic components, such as iron. Iron is easy to rust and hence is the main object to prevent from rusting. Copper and aluminum are also used in precise instruments, and color change and corrosion inhibition should be also considered.

Precise instruments and industrial devices are operated with electrical power supply and require certain breakdown voltage resistance to ensure their electrical insulating property. Currently existing lubricants only have lubricating function but cannot fulfil the requirements for breakdown voltage resistance, and have instable lubricating property, leading to leakage of electricity or short circuit and the like. Meanwhile, currently existing lubricants use organic solvents that are environmental unfriendly and harmful for human health.

SUMMARY OF THE INVENTION

An object of the present invention is to provide a lubricant composition that has excellent anti-corrosion property and excellent electrical insulating property while maintaining excellent lubricating property. In other words, the composition of the present invention has good balance among anti-corrosion property, electrical insulating property and lubricating property.

The lubricant composition of the present invention comprises, consists essentially of or consists of:

A) a corrosion inhibitor comprising, consisting essentially of or consisting of A1 and A2:
   - A1: 0.3-3 wt. % of one or more octadecylamine N-C10-20 alkanoyl sarcosinates,
   - A2: 1-5 wt. % of one or more substances selected from lanolin magnesium soap, lanolin calcium soap, lanolin barium soap, lanolin lithium soap, barium petroleum sulfonate and sodium petroleum sulfonate, B) 0.2-2 wt. % of one or more surfactants selected from Span-80, AEO-9 and TX-4, C) 10-40 wt. % of a lubricant base, D) 0.2-2 wt. % of fullerene C60, E) 50-80 wt. % of a solvent selected from D80, D100 and D110, and F) Optionally, a propellant gas;

all wt. % percentages are based on the total weight of the lubricant composition.

Preferably, the octadecylamine N—$C_{10-20}$ alkanoyl sarcosinate is selected from octadecylamine N-oleoyl sarcosinate, octadecylamine N-palmitoyl sarcosinate, octadecylamine N-myristoyl sarcosinate, and octadecylamine N-lauroyl sarcosinate. More preferably, the octadecylamine N—$C_{10-20}$ alkanoyl sarcosinate is octadecylamine N-oleoyl sarcosinate and/or octadecylamine N-lauroyl sarcosinate.

Preferably, component A2 is selected from lanolin magnesium soap, lanolin calcium soap, lanolin barium soap, and lanolin lithium soap.

Preferably, the lubricant base is selected from 15 #white mineral oil, 32 #lubricant base, 46 #lubricant base, 68 #lubricant base, 400SN lubricant base, 150N lubricant base, 400N lubricant base, and 500N lubricant base.

The advantages of the present invention include: 1) the lubricant composition has high breakdown voltage compared with conventional lubricant compositions, and hence can ensure the operation safety under electrical power supply and prevent leakage of electricity and short circuit, 2) the lubricant composition is friendly to environment and human health, due to free of highly toxic components.

DETAILED DESCRIPTION OF THE INVENTION

It is to be understood by one of ordinary skill in the art that the present discussion is a description of exemplary embodiments only and is not intended as limiting the broader aspects of the present invention. Each aspect so described may be combined with any other aspect(s) unless clearly indicated to the contrary. In particular, any feature indicated as being preferred or advantageous may be combined with any other feature or features indicated as being preferred or advantageous.

Unless specified otherwise, as used herein, the terms "a," "an" and "the" include both singular and plural referents.

The terms "comprising" and "comprises" as used herein are synonymous with "including," "includes" or "containing," "contains," and are inclusive or open-ended and do not exclude additional, non-recited members, elements or process steps.

The term "consisting essentially of" as used herein means that the listed components constitute main body of the composition, for example, at least 90% by weight of the composition, at least 95% by weight of the composition, or at least 97% by weight of the composition, and other unlisted component(s) will not affect the effects of the composition.

The term "consisting of" as used herein is close-ended and exclude additional, non-recited members, elements or process steps. However, containing non-intentional impurities in the composition will be deemed as falling in the scope defined by "consisting of."

The term "at least one" or "one or more" used herein to define a component refers to the type of the component, and not to the absolute number of molecules.

The terms "about," "around" and the like used herein in connection with a numerical value refer to the numerical value ±10%, preferably ±5%. All numerical values herein should be interpreted as being modified by the term "about."

Unless specified otherwise, the recitation of numerical end points includes all numbers and fractions subsumed within the respective ranges, as well as the recited end points.

All references cited in the present specification are hereby incorporated by reference in their entirety.

Unless otherwise defined, all terms used in the present invention, including technical and scientific terms, have the meaning as commonly understood by one of the ordinary skilled in the art to which this invention belongs.

Hereinafter the lubricant composition of the present invention will be described in detail.

Component A) Corrosion Inhibitor

The corrosion inhibitor imparts the anti-corrosion property to the lubricant composition of the present invention. In combination with other components, the corrosion inhibitor shall impart anti-corrosion property but also help to maintain the lubricating property and electrical insulating property.

After intensive research, the inventors found that octadecylamine N—$C_{10-20}$ alkanoyl sarcosinates are environmental-friendly and can form a dense protection layer on the surface of nonferrous metals and ferrous metals such that oxidative corrosion can be prevented. However, if too much octadecylamine N—$C_{10-20}$ alkanoyl sarcosinates are used to improve the anti-corrosion property, the electrical insulating property may be damaged. In order to find a way to balance the electrical insulating property and the anti-corrosion property, using octadecylamine N—$C_{10-20}$ alkanoyl sarcosinates together with other corrosion inhibitor(s) is developed in the present invention.

The corrosion inhibitor A) of the present invention comprises, consists essentially of, or consists of A1 and A2, wherein A1 is one or more octadecylamine N—$C_{10-20}$ alkanoyl sarcosinates and A2 is one or more substances selected from lanolin magnesium soap (which for example, can be formed from sodium stearate and magnesium sulfate), lanolin calcium soap (CAS No. 68424-44-2), lanolin barium soap (CAS No. 61788-50-9), lanolin lithium soap (CAS No. 68154-72-3), barium petroleum sulfonate and sodium petroleum sulfonate.

Preferably, component A1 is selected from octadecylamine N-oleoyl sarcosinate, octadecylamine N-palmitoyl sarcosinate, octadecylamine N-myristoyl sarcosinate, and octadecylamine N-lauroyl sarcosinate. More preferably, component A1 is octadecylamine N-oleoyl sarcosinate and/or octadecylamine N-lauroyl sarcosinate.

The octadecylamine N—$C_{10-20}$ alkanoyl sarcosinate can be formulated by N—$C_{10-20}$ alkanoyl sarcosinate and octadecylamine with molar ratio of 1:1. For example, octadecylamine N-oleoyl sarcosinate is formulated by N-oleoyl sarcosinate (CAS No. 110-25-8) and octadecylamine (CAS No. 124-30-1) with molar ratio of 1:1, and octadecylamine N-lauroyl sarcosinate is formulated by sodium N-lauroyl sarcosinate (CAS No. 137-16-6) and octadecylamine with molar ratio of 1:1.

Preferably, component A2 is selected from lanolin magnesium soap, lanolin calcium soap, lanolin barium soap, and lanolin lithium soap.

In the present invention, component A1 is in an amount of 0.3-3 wt. %, preferably 0.4-2.5 wt. %, such as, 0.5 wt. %, 0.6 wt. %, 0.7 wt. %, 0.8 wt. %, 0.9 wt. %, 1.0 wt. %, 1.1 wt. %, 1.2 wt. %, 1.3 wt. %, 1.4 wt. %, 1.5 wt. %, 1.6 wt. %, 1.7 wt. %, 1.8 wt. %, 1.9 wt. %, 2.0 wt. %, 2.1 wt. %, 2.2 wt. %, 2.3 wt. %, 2.4 wt. %, 2.6 wt. %, 2.7 wt. %, 2.8 wt. %, 2.9 wt. %, each based on total weight of the lubricant composition. An amount of A1 outside the above range cannot achieve desired properties.

In the present invention, component A2 is in an amount of 1-5 wt. %, preferably 1.5-4 wt. %, such as, 1.2 wt. %, 1.3 wt. %, 1.4 wt. %, 1.6 wt. %, 1.7 wt. %, 1.8 wt. %, 1.9 wt. %, 2.0 wt. %, 2.1 wt. %, 2.2 wt. %, 2.3 wt. %, 2.4 wt. %, 2.5 wt. %, 2.6 wt. %, 2.8 wt. %, 3.0 wt. %, 3.2 wt. %, 3.5 wt. %, 3.8 wt. %, 4.0 wt. %, 4.2 wt. %, 4.5 wt. %, 4.8 wt. %, each based on total weight of the lubricant composition. An amount of A2 outside the above range cannot achieve desired properties.

In the present invention, excellent anti-corrosion property refers to a value of greater than 32 h under Natural Salt Spray (NSS) test according to DIN 50021-EN (1988) (For further details please see the examples section).

Component B)

The component B) of the present invention is a surfactant and is used for adjusting the surface tension of the lubricant composition. The surface tension is an important factor during use. If the surface tension is too high, the applied lubricant composition would form sphere-like droplets and is difficult to spread, leading to poor lubrication property and/or poor electrical insulating property. if the surface tension is too low, the applied lubricant composition would spread too fast and cannot form a suitable lubricant film and would be too hydrophilic to expel moisture, also leading to poor lubrication property and/or poor electrical insulating property.

After inventive study, the inventors found that one or more surfactants selected from Span-80, AEO-9 and TX-4 is/are suitable to be used in the lubricant composition of the present invention and can help the lubricant composition achieve desired surface tension, wherein Span-80 is sorbitan monooleate with CAS No. 1338-43-8; AEO-9 is fatty alcohol polyoxyethylene (9) ether with formula of R—O—$(CH_2CH_2O)_nH$ (R=$C_{12-18}$, n=9) and is an addition product of natural fatty alcohol and ethylene oxide; TX-4 is a polyoxyethylene(4) nonyl phenyl ether.

In the present invention, suitable surface tension refers to a range of from 20 to 30 Mn/m determined according to GB/T 6541-1986 (details please see the examples section). A surface tension value outside the above range cannot achieve desired lubrication property and/or electrical insulating property.

In the present invention, component B) is in an amount of 0.2-2 wt. %, preferably 0.5-1.5 wt. %, such as, 0.3 wt. %, 0.4 wt. %, 0.5 wt. %, 0.6 wt. %, 0.7 wt. %, 0.8 wt. %, 0.9 wt. %, 1.0 wt. %, 1.1 wt. %, 1.2 wt. %, 1.3 wt. %, 1.4 wt. %, 1.5 wt. %, 1.6 wt. %, 1.7 wt. %, 1.8 wt. %, 1.9 wt. %, each based on total weight of the lubricant composition. An amount of the component B) outside the above range cannot achieve desired properties.

Component C)

The component C) is a lubricant base that can impart both lubricating property and insulating property to the composition of the present invention.

The lubricant base is a conventional lubricating agent and has CAS No. 8002-05-9. Preferably, the lubricant base useful in the present invention is selected from 15 #white mineral oil, 32 #lubricant base, 46 #lubricant base, 68 #lubricant base, 400SN lubricant base, 150N lubricant base, 400N lubricant base, and 500N lubricant base.

Taking viscosity index, kinematic viscosity and flash point into consideration, 500N lubricant base is the best one, while other listed lubricant bases can also achieve desired properties.

In the present invention, the component C) is in an amount of 10-40 wt. %, preferably 20-35 wt. %, such as, 15 wt. %, 18 wt. %, 20 wt. %, 22 wt. %, 24 wt. %, 26 wt. %, 28 wt. %, 30 wt. %, 32 wt. %, 34 wt. %, 36 wt. %, 38 wt. %, each based on total weight of the lubricant composition. An amount of the component C) outside the above range cannot achieve desired properties.

Component D)

The component D) is fullerene C60, which has CAS No. 131159-39-2 and can reduce friction and impart wear-resistance to the composition and can protect the devices from wear damage. However, the amount of fullerene C60 cannot be too large, otherwise, the lubricating property would not increase, and wear resistance would decrease.

In the present invention, the component D) is in an amount of 0.2-2 wt. %, preferably 0.3-1 wt. %, such as, 0.4 wt. %, 0.5 wt. %, 0.6 wt. %, 0.7 wt. %, 0.8 wt. %, 0.9 wt. %, 1.0 wt. %, 1.1 wt. %, 1.2 wt. %, 1.3 wt. %, 1.4 wt. %, 1.5 wt. %, 1.6 wt. %, 1.7 wt. %, 1.8 wt. %, 1.9 wt. %, each based on total weight of the lubricant composition. An amount of the component D) outside the above range cannot achieve desired properties.

Component E)

The component E) is a solvent selected from solvent oils D80, D100 and D110. These solvent oils are low cost and low toxic and have strong solvency and high flash point, and they also have good penetrability and good solvency to non-polar greasy dirt and can remove non-polar greasy dirt and polar dirts like carbon deposition, resins, dusts, rusts, moisture and the like.

In order to ensure the non-inflammability of the lubricant composition, suitable solvents shall have a closed-cup flash point of greater than 60° C. Moreover, solvent oil D100 is the best one in terms of moderate flowability, while D80 and D110 can also achieve the desired properties.

In the present invention, the component E) is in an amount of 50-80 wt. %, preferably 55-70 wt. %, such as, 52 wt. %, 54 wt. %, 56 wt. %, 58 wt. %, 60 wt. %, 62 wt. %, 64 wt. %, 66 wt. %, 68 wt. %, 70 wt. %, 72 wt. %, 74 wt. %, 76 wt. %, 78 wt. %, each based on total weight of the lubricant composition. An amount of the component E) outside the above range cannot achieve desired properties.

Component F)

The component F) is a propellant gas for propelling the composition out of the container. The propellant gas is optional in the lubricant composition.

The propellant gas can be conventional propellant gas in the art such as nitrogen gas and carbon dioxide. In order to formulate an environmental-friendly lubricant composition, nitrogen gas is the preferred propellant gas, and nitrogen gas can be used alone or be used together with carbon dioxide.

The propellant gas can be used in any suitable amount as long as the composition can be propelled out appropriately. Preferably, the component F) is in an amount of 1-5 wt. %, preferably 1.5-4 wt. %, such as, 1.2 wt. %, 1.3 wt. %, 1.4 wt. %, 1.6 wt. %, 1.7 wt. %, 1.8 wt. %, 1.9 wt. %, 2.0 wt. %, 2.1 wt. %, 2.2 wt. %, 2.3 wt. %, 2.4 wt. %, 2.5 wt. %, 2.6 wt. %, 2.8 wt. %, 3.0 wt. %, 3.2 wt. %, 3.5 wt. %, 3.8 wt. %, 4.0 wt. %, 4.2 wt. %, 4.5 wt. %, 4.8 wt. %, each based on total weight of the lubricant composition.

The balance of excellent anti-corrosion property, excellent electrical insulating property and excellent lubricating property of the lubricant composition of the present invention is achieved by carefully selecting each component as well as amount thereof, and the combination of these components and their amounts contribute to the balance of excellent properties. It is hard to say which component plays the key role in achieving these excellent properties, but these components together along with their specific amounts can lead to these excellent properties.

Method for Preparing the Lubricant Composition

The lubricant composition can be prepared by uniformly mixing the components together and filling the mixture into a suitable container, and if necessary, filling the propellant gas into the container. During mixing, the mixture can be heated and/or stirred, if necessary, so as to ensure uniformly mixing.

EXAMPLES

The invention will now be described by way of the following examples. The following examples are intended to assist one skilled in the art to better understand and practice the present invention. The scope of the invention is not limited by the examples but is defined in the appended claims. All parts and percentages are based on weight unless otherwise stated.

Test Methods Used in the Examples

Breakdown Voltage Test

Breakdown voltage was tested using full-automatic insulating oil dielectric strength tester according to National standard GB/T 507-2002: Insulating Liquids-Determination of the breakdown voltage at power frequency.

Test Notes:

1. Samples were not dried or degassed during the test, unless indicated otherwise, and the difference between the sample temperature and the environment temperature was not greater than 5° C., and the sample temperature during arbitration test was 20±5° C.
2. Before pouring the sample into the sample cup, gently shaking and reversing the sample in container so as to make the impurities distribution as uniform as possible and no bubble being formed, and avoiding the sample to be contacted with air.
3. Before the test, pouring out the original insulating oil in the sample cup, immediately cleaning the cup wall, electrodes and other parts with the sample to be tested, and then slowly pouring in the sample to be tested to avoid bubbles; putting the sample cup on the tester, if stirring is needed, turning on the stirrer; measuring and recording the sample temperature.
4. 5 minutes later after completion of sample installation and having checked that there is no visible bubble between the electrodes, applying the voltage at the first time, then slowly increasing the voltage between electrodes at the rate of 2.0 kV/s±0.2 Kv/s until the sample breakdown. The breakdown voltage is the maximum voltage value when the circuit is automatically disconnected (generating constant arc) or manually disconnected (audible or visible discharge). Recording the breakdown voltage value. After reaching the breakdown voltage, pause for at least 2 minutes, and repeating for 6 times.
5. Calculating the average value of 6 breakdown voltage values and reporting the average value as the test result (unit: kV).

Salt Spray Test

Salt spray test was carried out using Natural Salt Spray (NSS) according to standard DIN 50021-EN (1988): Salt spray testing.

In the NSS test, using 5% NaCl aqueous solution with pH value in the range of 6 to 7 as the spray solution, the test temperature was set at 35±1° C., salt spray precipitation rate was set at 1-2 ml/80 cm2 h. Results are recorded and ranked as follows:

Not pass: lower than 25 h;
Pass: from 25 h to lower than 30 h;
Good: from 30 h to lower than 32 h;
Excellent: equal to or greater than 32 h.

Surface Tension Test

The surface tension was tested with MC-1021 (available from BANGYES Precise Instrument (Shanghai) Ltd) type full-automatic surface tension tester according to GB/T 6541-1986: Petroleum products-mineral oils-Determination of interfacial tension of oil against water-Ring method.

Friction Test

The friction was tested with MRS-10A (available from Shanghai BiaoZhuo Scientific Instrument Ltd.) type four-ball wear tester according to SH/T 0762-2005: The test method for determination of the coefficient of friction of lubricants using the four-ball wear test machine.

The test results are shown in failure load (N). Failure loads are 98.1N, 196.2N, 294.3N, 392.4N, 490.5N, 588.6N, 686.7N, 784.8N, 882.9N, 981.0N, and the greater the value is, the better the lubrication is.

Formulation Preparation

Formulations were prepared using components listed in the following Tables. Taking Example B4 for example, the formulation was prepared by mixing 2 parts by weight of Octadecylamine N-oleoyl sarcosinate, 2 parts by weight of Lanolin magnesium soap, 62.5 parts by weight of solvent oil D100 and 0.5 parts by weight of Fullerene C60 under heating (such as 60-80° C.) and stirring until a clear liquid was obtained, then adding and dispersing 1 part by weight of Span-80 and 30 parts by weight of lubricant base; filtering the obtained mixture and filing the filtered mixture into a sealed aerosol container and then filing thereto 2 parts by weight of nitrogen gas. Other Examples were prepared using similar procedure except that the components and amounts are different.

TABLE 1

Selection of corrosion inhibitor

| Components | Example A1 | Example A2 | Example A3 | Example A4 | Example A5 |
|---|---|---|---|---|---|
| Octadecylamine N-oleoyl sarcosinate [11] | 2 | | | | |
| Barium petroleum sulfonate | | 2 | | | |
| Sodium petroleum sulfonate | | | 2 | | |
| T746 [12] | | | | 2 | |
| Lanolin magnesium soap | | | | | 2 |
| Fullerene C60 | 0.5 | 0.5 | 0.5 | 0.5 | 0.5 |
| 500N Lubricant base | 30 | 30 | 30 | 30 | 30 |
| Span-80 [13] | 1 | 1 | 1 | 1 | 1 |
| D100 [14] | 64.5 | 64.5 | 64.5 | 64.5 | 64.5 |
| Nitrogen gas | 2 | 2 | 2 | 2 | 2 |
| NSS test/h | 32 | 28 | 23 | 20 | 30 |
| | Excellent | Pass | Not pass | Not pass | Good |

[11] T711, formulated by N-oleoyl sarcosine and octadecylamine with molar ratio of 1:1

[12] Dodecenylsuccinic acid

[13] Sorbitan monooleate

[14] De-aromatic Solvent Oil D100

TABLE 2

Selection of corrosion inhibitor combination

| Components | Example B1 | Example B2 | Example B3 | Example B4 |
|---|---|---|---|---|
| Octadecylamine N-oleoyl sarcosinate | 2 | 2 | 2 | 2 |
| Barium petroleum sulfonate | 2 | | | |
| Sodium petroleum sulfonate | | 2 | | |
| T746 | | | 2 | |
| Lanolin magnesium soap | | | | 2 |
| Fullerene C60 | 0.5 | 0.5 | 0.5 | 0.5 |
| 500N Lubricant base | 30 | 30 | 30 | 30 |
| Span-80 | 1 | 1 | 1 | 1 |
| D100 | 62.5 | 62.5 | 62.5 | 62.5 |
| Nitrogen gas | 2 | 2 | 2 | 2 |
| NSS test/h | 40 | 32 | 30 | 42 |
| | Excellent | Excellent | Good | Excellent |

It can be seen from the above Tables 1 and 2 that excellent anti-corrosion property can be achieved using octadecylamine N-oleoyl sarcosinate together with lanolin magnesium soap, or with barium petroleum sulfonate, or with sodium petroleum sulfonate.

TABLE 3

Selection of surface tension-influencing component

| Components | Example C1 | Example C2 | Example C3 | Example C4 | Example C5 |
|---|---|---|---|---|---|
| Octadecylamine N-oleoyl sarcosinate | 2 | 2 | 2 | 2 | 2 |
| Lanolin magnesium soap | 2 | 2 | 2 | 2 | 2 |
| TX-4 [31] | 1 | | | | |
| AES [32] | | 1 | | | |
| AEO-9 [33] | | | 1 | | |
| Span-80 | | | | 1 | |
| Triethanolamine | | | | | 1 |
| Fullerene C60 | 0.5 | 0.5 | 0.5 | 0.5 | 0.5 |
| 500N Lubricant base | 30 | 30 | 30 | 30 | 30 |
| D100 | 62.5 | 62.5 | 62.5 | 62.5 | 62.5 |
| Nitrogen gas | 2 | 2 | 2 | 2 | 2 |
| Surface tension Mn/m | 22 | 15 | 20 | 26 | 18 |
| | Pass | Not pass | Pass | Pass | Not pass |

[31] Polyoxyethylene(4) nonyl phenyl ether

[32] Fatty alcohol polyoxyethylene ether, sodium sulfate

[33] Fatty Alcohol Polyoxyethylene(9) Ether

The bigger the surface tension is, the harder the spreading is. In the present invention, a moderate surface tension is required, and fast spreading and much slow spreading are not desired. So, a surface tension between 20 to 30 Mn/in is designated as pass, outside this range is designated as not pass.

TABLE 4

Selection of lubrication-influencing components

| Component | Example D1 | Example D2 | Example D3 | Example D4 | Example D5 |
|---|---|---|---|---|---|
| Octadecylamine N-oleoyl sarcosinate | 2 | 2 | 2 | 2 | 2 |
| Lanolin magnesium soap | 2 | 2 | 2 | 2 | 2 |
| Span-80 | 1 | 1 | 1 | 1 | 1 |
| Fullerene C60 | 0.5 | / | 1 | 0.5 | 0.5 |
| 500N Lubricant base | 30 | 30 | 30 | 15 | 45 |
| D100 | 62.5 | 62.5 | 62.5 | 62.5 | 62.5 |
| Nitrogen gas | 2 | 2 | 2 | 2 | 2 |
| Breakdown voltage/KV | 55 | 57 | 36 | 44 | 46 |
| Failure load/N | 981.0 | 294.3 | 981.0 | 588.6 | 882.9 |

The bigger the failure load is, the better the lubricity is. It can be seen from the above table that the amount of Fullerene C60 can greatly affect the lubricity, and the amount of the lubricant base can also affect the lubricity. Meanwhile, the amounts of Fullerene C60 and lubricant base will also affect the breakdown voltage of the composition, so, suitable amounts of Fullerene C60 and lubricant base are required for achieving the balance of all properties.

TABLE 5

| Component | Example E1 | Example E2 | Example E3 | Example E4 | Example E5 | Example E6 | Example E7 |
|---|---|---|---|---|---|---|---|
| Octadecylamine N-oleoyl sarcosinate | 0.5 | 2 | 4 | 0.5 | 0.5 | 0.5 | 0.5 |
| Lanolin magnesium soap | 2 | 2 | 2 | 0.5 | 4 | 2 | 2 |
| Span-80 | 1 | 1 | 1 | 1 | 1 | / | 3 |
| Fullerene C60 | 0.5 | 0.5 | 0.5 | 0.5 | 0.5 | 0.5 | 0.5 |
| 500N Lubricant base | 30 | 30 | 30 | 30 | 30 | 30 | 30 |
| D100 | 64 | 62.5 | 60.5 | 65.5 | 62 | 65 | 62 |
| Nitrogen gas | 2 | 2 | 2 | 2 | 2 | 2 | 2 |
| | | | Properties | | | | |
| Breakdown voltage/KV | 55 | 48 | 33 | 50 | 51 | 50 | 28 |
| NSS test/h | 44 | 42 | 38 | 6 | 46 | 43 | 39 |
| Failure load/N | 981.0 | 981.0 | 981.0 | 981.0 | 981.0 | 981.0 | 981.0 |
| Surface tension Mn/m | 24 | 26 | 25 | 27 | 30 | 41 | 17 |
| Overall evaluation | Pass | Pass | Not Pass | Not Pass | Pass | Not Pass | Not Pass |

It can be seen from Table 5 that in Example E3, larger amount of Octadecylamine N-oleoyl sarcosinate cannot achieve the desired balance of all properties, that is, cannot achieve excellent breakdown voltage (in the present invention, greater than 35 KV of breakdown voltage is designated as excellent); in Example E4, lower amount of Lanolin magnesium soap cannot achieve the desired balance of all properties, that is, cannot achieve acceptable NSS test result; in Example E6, free of Span-80 cannot achieve acceptable surface tension; in Example E7, larger amount of Span-80 cannot achieve excellent breakdown voltage; in inventive Examples 1, 2 and 5, excellent breakdown voltage (greater than 35 KV, i.e., excellent electrical insulating property), excellent NSS test result (even greater than 36 h, i.e., excellent anti-corrosion property), excellent failure load (981.0N, i.e., excellent lubricating property), and suitable surface tension (between 20-30 Mn/m) can be achieved.

TABLE 6

| Component | Example F1 | Example F2 | Example F3 | Example F4 |
|---|---|---|---|---|
| Octadecylamine N-oleoyl sarcosinate | 0.5 | 0.5 | 0.5 | 0.5 |
| Lanolin magnesium soap | 2 | | | |
| Lanolin calcium soap | | 2 | | |
| Lanolin barium soap | | | 2 | |
| Lanolin lithium soap | | | | 2 |
| Fullerene C60 | 0.5 | 0.5 | 0.5 | 0.5 |
| Span-80 | 1 | 1 | 1 | 1 |
| 500N Lubricant base | 30 | 30 | 30 | 30 |
| D100 | 64 | 64 | 64 | 64 |
| Nitrogen gas | 2 | 2 | 2 | 2 |
| NSS test /h | 44 | 42 | 42 | 41 |

It can be seen from Table 6 that using Octadecylamine N-oleoyl sarcosinate together with Lanolin magnesium soap or Lanolin calcium soap or Lanolin barium soap or Lanolin lithium soap can achieve almost the same NSS test result.

TABLE 7

| Component | Example G1 | Example G2 |
|---|---|---|
| Octadecylamine N-oleoyl sarcosinate | 0.5 | |
| Octadecylamine N-lauroyl sarcosinate [71] | | 0.5 |
| Lanolin magnesium soap | 2 | 2 |
| Span-80 | 1 | 1 |
| Fullerene C60 | 0.5 | 0.5 |
| Span-80 | 30 | 30 |
| 500N Lubricant base | 64 | 64 |
| D100 | 2 | 2 |
| NSS test /h | 44 | 42 |

[71] Formulated by sodium N-lauroyl sarcosine and octadecylamine with molar ratio of 1:1

It can be seen from Table 7 that using Octadecylamine N-oleoyl sarcosinate or Octadecylamine N-lauroyl sarcosinate together with Lanolin magnesium soap can achieve substantially the same NSS test result.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A lubricant composition comprising:

A) a corrosion inhibitor comprising A1 and A2:

A1: 0.3-3 wt. % of one or more octadecylamine N—$C_{10-20}$ alkanoyl sarcosinates, A2: 1-5 wt. % of one or more substances selected from lanolin magnesium soap, lanolin calcium soap, lanolin barium soap, lanolin lithium soap, barium petroleum sulfonate and sodium petroleum sulfonate, B) 0.2-2 wt. % of one or more surfactants selected from Span-80, AEO-9 and TX-4, C) 10-40 wt. % of a lubricant base, D) 0.2-2 wt. % of fullerene C60, E) 50-80 wt. % of a solvent selected from D80, D100 and D110, and F) Optionally, a propellant gas;

all wt. % percentages are based on total weight of the lubricant composition.

2. The composition according to claim 1, wherein the one or more octadecylamine N—$C_{10-20}$ alkanoyl sarcosinates is/are selected from octadecylamine N-oleoyl sarcosinate, octadecylamine N-palmitoyl sarcosinate, octadecylamine N-myristoyl sarcosinate, and octadecylamine N-lauroyl sarcosinate.

3. The composition according to claim 1, wherein component A1, the one or more octadecylamine N—$C_{10-20}$ alkanoyl sarcosinate is octadecylamine N-oleoyl sarcosinate and/or octadecylamine N-lauroyl sarcosinate; and component A2 is selected from lanolin magnesium soap, lanolin calcium soap, lanolin barium soap, and lanolin lithium soap.

4. The composition according to claim 1, wherein the lubricant base C) is selected from 15 #white mineral oil, 32 #lubricant base, 46 #lubricant base, 68 #lubricant base, 400SN lubricant base, 150N lubricant base, 400N lubricant base, and 500N lubricant base.

5. The composition according to claim 1, wherein the propellant gas is $N_2$ and/or $CO_2$, the propellent gas being present in an amount of 1.2 to 4.5 wt. %.

6. The composition according to claim 1, wherein component A1 is present in an amount of 0.4-2.5 wt. %.

7. The composition according to claim 1, wherein component A2 is in an amount of 1.5-4 wt. %.

8. The composition according to claim 1, wherein component B) is in an amount of 0.5-1.5 wt. %.

9. The composition according to claim 1, wherein component C) is in an amount of 20-35 wt. %.

10. The composition according to claim 1, wherein component D) is in an amount of 0.3-1 wt. %.

11. The composition according to claim 1, wherein component E) is in an amount of 55-70 wt. %.

12. The composition according to claim 1, wherein component F) the propellant gas is present in an amount of 1-5 wt. %.

* * * * *